US005188919A

United States Patent [19]

Dewanckele et al.

[11] Patent Number: 5,188,919

[45] Date of Patent: Feb. 23, 1993

[54] PARTICULATE TONER MATERIAL CONTAINING CHARGE CONTROLLING COMPOUND

[75] Inventors: Jean-Marie O. Dewanckele, Drongen; Serge M. Tavernier; Jean-Pierre A. Ghekiere, both of Lint, all of Belgium

[73] Assignee: Agfa-Gevaert, N.V., Mortsel, Belgium

[21] Appl. No.: 744,410

[22] Filed: Aug. 13, 1991

[30] Foreign Application Priority Data

Aug. 22, 1990 [EP] European Pat. Off. ..... 90202254.0

[51] Int. Cl.[5] ..... G03G 9/097

[52] U.S. Cl. ..... 430/106; 430/106.6; 430/110; 430/903; 524/904; 525/934

[58] Field of Search ..... 430/106, 106.6, 110

[56] References Cited

U.S. PATENT DOCUMENTS 4,268,598 5/1981 Leseman et al. ..... 430/110 X
4,464,452 8/1984 Gruber et al. ..... 430/110

FOREIGN PATENT DOCUMENTS 172156 8/1986 Japan ..... 430/110
293250 12/1987 Japan ..... 430/110
208864 8/1988 Japan ..... 430/110
173062 7/1989 Japan ..... 430/110

*Primary Examiner*—Roland Martin
*Attorney, Agent, or Firm*—Breiner & Breiner

[57] ABSTRACT

Particulate toner material for use in the development of latent electrostatic images, wherein said particulate toner material is capable of acquiring by triboelectric contact electrification a net negative charge and contains thermoplastic resin(s) as binder in combination with a colorant and a compound capable of imparting a negative charge to the particulate toner material in contact electrification, wherein the latter compound is an anthranilic acid derivative comprising a sulfonamido-group.

12 Claims, No Drawings

PARTICULATE TONER MATERIAL CONTAINING CHARGE CONTROLLING COMPOUND

DESCRIPTION

1. Field of the Invention

The present invention relates to particulate toner material for developing electrostatic charge patterns or images. In particular the present invention relates to charge controlling agents for incorporation in such toner material and which more particularly are useful in full-color imaging applications.

2. Background Art

The electrophotographic process and image-forming apparatus based upon the application of this process are widespread nowadays and well known to those skilled in the art. Particular aspects of the xerographic process are set forth in R. M. Schaffert "Electrophotography", the Focal Press, London, N.Y, enlarged and revised edition, 1975, as well as in numerous patent specifications.

One of the critical factors in the overall electrophotographic process is the developing of the electrostatic charge pattern, whereby a variety of electrostatic developers may be used. A distinction is made between dry and liquid developers. In dry developers a distinction is made between single-component and two-component developers which are actually developers wherein carrier particles are mixed with toner particles (ref. Evan S. Baltazzi, Recent Development in Electrophotographic Processes, Materials, and Related Fields-Journal of Applied Photographic Engineering, Vol. 6, No. 6, Dec. 1980, p. 147–152). In two-component developers the carrier particles may comprise various materials and as the name implies, serve as a medium for carrying the electrostatically responsive marking particles to the charge pattern to be developed. Carrier-toner developers can be used in cascade development as described e.g. in U.S. Pat. No. 2,618,552 or in magnetic brush development as described e.g. in U.S. Pat. No. 3,003,462.

The cascade development technique is carried out by rolling or cascading across the electrostatic latent image bearing surface, a developing mixture composed of relatively large carrier particles, each having a number of electrostatically adhering toner particles on its surface. As this mixture rolls across the image-bearing surface, the toner particles are electrostatically deposited on the charged portions of the image.

The magnetic brush development technique involves the use of magnetic means associated with a developing mixture composed of magnetic carrier particles carrying a number of smaller electrostatically adhering toner particles. In this technique the developer composition is maintained during the development cycle in a loose, brushlike orientation by a magnetic field surrounding, for example, a rotatable non-magnetic cylinder having a means with magnetic poles mounted inside. The magnetic carrier particles are attracted to the cylinder by the described magnetic field, and the toner particles are held to the carrier particles by virtue of their opposite electrostatic polarity. Before and during development, the toner acquires an electrostatic charge of a sign opposite to that of the carrier material due to triboelectric charging derived from their mutual frictional interaction. When this brushlike mass of magnetic carrier with adhering toner particles is drawn across the surface bearing the electrostatic image, the toner particles are electrostatically attracted to an oppositely charged latent image and form a visible toner image corresponding to the electrostatic image. Since electrostatic charge remains in the non-exposed areas of a photoconductive surface electrophotography is inherently a direct positive process. In some instances, however, photocopying requires the production of positive prints from photographic negatives.

Such is possible with line negatives as original due to the fringe effect. By the fringe effect negative charges will be induced in the exposed areas which carried originally positive charges, the said charges having leaked off by the photoexposure. So, if a photoconductor coating that was originally overall charged positively has lost its positive charge in correspondence with the line pattern of the original negative, charges of negative sign will be induced in the exposed line pattern by the fringe effect of the still surrounding positive charge pattern. Such makes that positively charged toner will become attracted by said negative charges and a positive image will be developed with respect to the original negative.

Reversal development of large image area will likewise be possible by applying a bias voltage to a magnetic brush applicator which acting as a development electrode induces when positively charged, through the conductive carrier particles a negative charge in the discharged area of the previously positively charged photoconductor coating (ref. R. M. Schaffert "Electrophotography" The Focal Press—London, N.Y enlarged and revised edition 1975 p. 50–51 and T. P. Maclean "Electronic Imaging" Academic Press—London, 1979 p. 231).

In dry toner development systems the toner is normally a fine powder of natural or synthetic resins having a colorant and charge controlling agent dissolved or dispersed therein.

Known positive charge controlling compounds for use in dry toners are dye bases and salts thereof such as nigrosine dye base and salts described in GB-P 1,253,573. Such charge controlling agents are usually added to the thermoplastic resin to be dispersed in the resin in molten state. Upon cooling the mixture is micropulverized and the particles with desired particle size are separated e.g. by air classification.

Coloured charge controlling substances have the disadvantage that their colour interferes with the colour intentionally given to the toner mass. For the obtaining of neutral black or spectrally pure colours required in multicolour reproduction the inherent colour of the charge controlling substance may form a serious obstacle. Therefore preference is given to the use of colourless charge controlling substances.

OBJECT OF THE INVENTION

It is an object of the present invention to provide a particulate toner material for developing electrostatic charge images which toner material contains a charge controlling agent with substantially colourless and transparent characteristics so that it does not interfere with the colouring agent of the toner material.

It is a further object of the present invention to provide such toner material wherein the charge controlling agent yields a particularly high negative charge to the toner particles and has a good miscibility or compatibility with the polymeric binder material present in the toner material.

Other objects and advantages of the present invention will become clear from the further description.

SUMMARY OF THE INVENTION

In accordance with the present invention there is provided particulate toner material for use in the development of latent electrostatic images, wherein said particulate toner material is capable of acquiring by triboelectric contact electrification a net negative charge and contains thermoplastic resin(s) as binder in combination with a compound capable of imparting a negative charge to the particulate toner material in contact electrification, characterized in that said compound corresponds to the following general formula I.

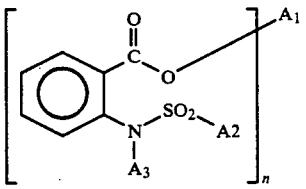

I wherein:

$A_1$ represents hydrogen, a counter ion or a mono- or polyvalent cyclic or acyclic aliphatic, aromatic or mixed aliphatic-aromatic hydrocarbon group e.g. alkyl, alkylene, alkynyl, aryl e.g. phenyl, arylene e.g. phenylene, alkarylene e.g. xylylene;

n represents 1 when $A_1$ represents hydrogen or a monovalent hydrocarbon group or represents an integer corresponding to the valency of the counter ion when $A_1$ represents a counter ion or corresponding to the valency of the polyvalent hydrocarbon group when $A_1$ represents such polyvalent hydrocarbon group;

$A_2$ represents an aryl, alkyl or aralkyl group, or substituted aryl, alkyl or aralkyl group, and $A_3$ represents hydrogen or an aryl, alkyl, or aralkyl group. The counter ion mentioned above may be either an onium group such as e.g. ammonium, phosphonium, sulfonium, or a metal ion.

In the particulate toner material according to the present invention said compound is used preferably in an amount in the range of 0.25 to 5% by weight with respect to the total toner composition.

DETAILED DESCRIPTION OF THE INVENTION

Examples of compounds for use according to the present invention are mentioned hereinafter together with the description of their preparation.

TABLE 1

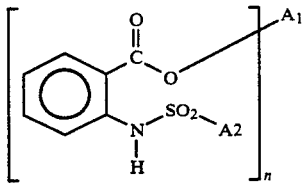

| Compound No. | $A_1$ | n | $A_2$ |
|---|---|---|---|
| 1 | $CH_3$ | 1 | 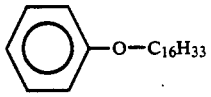 |
| 2 | $CH_3$ | 1 | 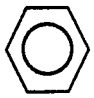 |
| 3 | $C_{16}H_{33}$ | 1 | 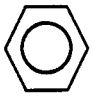 |
| 4 | $C_{12}H_{25}$ | 1 | 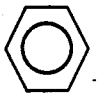 |
| 5 | $C_{18}H_{33}$ | 1 | 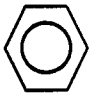 |
| 6 | H | 1 | 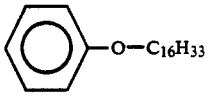 |
| 7 | H | 1 | $C_{16}H_{33}$ |
| 8 | Ni | 2 | 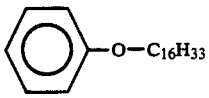 |
| 9 | Ni | 2 | $C_{16}H_{33}$ |
| 10 | Zn | 2 | 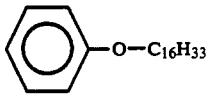 |
| 11 | Zn | 2 | $C_{16}H_{33}$ |
| 12 | Mg | 2 | 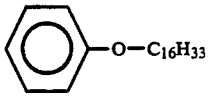 |
| 13 | Co | 2 | 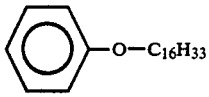 |

TABLE 1-continued

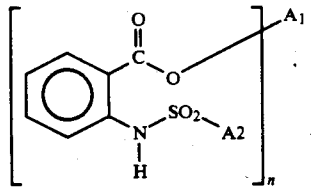

| Compound No. | $A_1$ | n | $A_2$ |
|---|---|---|---|
| 14 | Li | 1 | 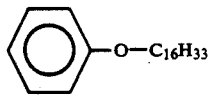 |

Preparation of Compound No. 1

208,2 g (0,5 mole) of p-hexadecyloxybenzene sulphochloride (J. Chem. Soc. 865 (1946), 83 g (0,55 mole) of anthranilic acid methylester and 69,6 ml (0,5 mole) of triethyl amine were refluxed whilst constantly stirring in 1250 ml of acetonitrile. The formed precipitate was separated by suction filtering and purified by cristallisation in ethanol.

Yield: 186 g. Melting point: 79° C.

Preparation of Compound No. 2

Compound No. 2 was prepared analogously to the preparation of compound No. 1 but by allowing to react benzenesulphochloride with anthranilic acid methylester.

Preparation of Compound No. 3

In a reaction vessel comprising a destillation column a mixture of 21,9 g (0,1 mole) of N-fenylsulphonylanthranilic acid methylester and 24,2 g (0.1 mole) of hexadecanol in 200 ml of toluene was dehydrated by azeotropic destillation of water.

Hereupon 0,2 ml of tetraisopropyltitanate (available from Du Pont de Nemours Co, under the trade mark Tyzol TPT) was carefully added to the reaction mixture and a toluene/methanol mixture was separated by destillation until (after about 8 hours) no toluene was remaining in the reaction vessel.

The reaction mixture was solidified by cooling and crystallised out of methanol.

Yield: 41,5 g. Melting point: 68° C.

Preparation of Compound No. 4

Compound No. 4 was prepared analogously to the preparation of compound No. 3 but by allowing to react dodecanol with N-phenylsulphonylanthranilic acid.

Preparation of Compound No. 5

Compound No. 5 was prepared analogously to the preparation of compound No. 3 but by allowing to react octadecanol with N-phenylsulphonylanthranilic acid.

Preparation of Compound No. 6

Over a period of 30 minutes whilst constantly stirring a solution of 105,5 g (1,6 mole) of potassium hydroxide 85% in 400 ml ethanol was added dropwise to a boiling solution of 170 g (0,32 mole) of 2(p-hexadecyloxyphenylsulphonamido)-benzoic-acid methylester in 1600 ml of ethanol. After two hours further refluxing the obtained suspension was cooled, separated by suction filtering and washed with ethanol.

During 30 min the humid precipitate was stirred in a mixture of 1500 ml of water and 100 ml of concentrated hydrochloric acid.

The precipitate was then separated by suction filtering, washed till neutralisation and crystallised out of ethanol.

Yield: 159 g. Melting point: 126° C.

Preparation of Compound No. 7

Compound No. 7 was prepared analogously to the preparation of compound No. 6 but by allowing to react 2(hexadecylsulphonamido)-benzoicacid methylester.

Preparation of Compound No. 8

A mixture of 51,7 g (0,1 mole) of 2-(p-hexadecyloxyphenylsulphonamido)-benzoicacid and 12,45 g (0,05 mole) of Nickel (II) acetate 4 aqua in 750 ml of methanol was refluxed for 4 hours. After cooling the precipitate was separated by suction filtering and crystallised out of methanol.

Yield: 52 g. Melting point: 100° C.

Preparation of Compound No. 9

Compound No. 9 was prepared analogously to the preparation of compound No. 8 but by allowing to react 2-hexadecylsulphonamidobenzoicacid.

Preparation of Compound No. 10

Compound No. 10 was prepared analogously to the preparation of compound No. 8 but by allowing to react Zinc (II) acetate 4 aqua.

Preparation of Compound No. 11

Compound No. 11 was prepared analogously to the preparation of compound No. 8 but by allowing to react 2-hexadecylsulphonamidobenzoicacid and zinc (II) acetate 4 aqua.

Preparation of Compound No. 12

Compound No. 12 was prepared analogously to the preparation of compound No. 8 but by allowing to react Magnesium (II) acetate 4 aqua.

Preparation of Compound No. 13

A solution of 31 g (0,06 mole) 2-(p-hexadecyloxyphenylsulphonamido)-benzoicacid and 2,4 g (0,06 mole) of sodium hydroxide in 900 ml of water was added dropwise at 80° C. to a solution of 7,14 g (0,03 mole) of Cobalt (II) chloride 6 aqua in 300 ml of water. After cooling the precipitate was separated by suction filtering and crystallised out of methanol.

Yield: 23,5 g. Melting point: 102° C.

Preparation of Compound No. 14

Whilst constantly stirring a solution of 1,44 g (0,06 mole) of lithium hydroxyde in 25 ml of methanol was added dropwise at room temperature to a suspension of 31 g (0,06 mole) of 2-(p-hexadecyloxyphenylsulfphonamido)benzoicacid in 350 ml of methanol. The reaction mixture is concentrated by evaporation of the solvents and crystallised out of a mixture of acetonitrile and ethanol.

Yield: 14,5 g. Melting point: 268° C.

The toner material can be prepared by any conventional technique such as spray drying a solution in a suitable volatile solvent or grinding a solidified composition of homogeneously mixed ingredients including a thermoplastic binder, and a negative charge-imparting compound or mixture of compounds according to said general formula I, and generally a colorant. In the absence of a colorant, the 'toner' hardly exerts any 'toning' or 'coloring' activity. Therefore in the vast majority of applications, a colorant, examples of which are set forth hereinafter, is added to the thermoplastic resin binder and the charge control agent to make up a full 'toner' composition. In color electrostatographic applications however it sometimes is advisable to cover the final copy substrate such as paper with a transparant (protective) layer of thermoplastic binder. The term 'toner material' as used in the present specification therefore includes as well compositions comprising a thermoplastic resin binder and a charge controlling agent without colorant, and consequently without an effective 'toning' function suitable e.g. for covering the paper substrate with a transparent glossy coating as described above, as well as compositions comprising a thermoplastic binder resin, a charge controlling agent and a colorant.

The toner particles have preferably a particle size in the range of 1 to 30 μm, and more preferably in the range of 1 to 20 μm.

When the electrostatographic process is applied in an apparatus aimed at producing high-quality xerographic prints, toner particles with a small average particle size and a particularly classified size distribution may be employed, such as disclosed in PCT/EP90/01027.

Although the charge controlling substances are preferably present in dissolved state in the thermoplastic resin binder of the toner, such is not strictly necessary. When said substances are present in dispersed state the colour of the colorant is seen less vivid by the opalescent character of the dispersion. However, the degree of this opalescence is small due to the high activity of the described charging agents, and hence the small amounts necessary for adequate charge control.

For obtaining a hard toner which is in favour of a longer developer lifetime because "smearing" of the toner particles on the carrier particles becomes less, preference is given to thermoplastic resins having a melting point in the range of 100° to 120° C. and containing in their structure a major part by weight of aromatic groups, e.g. phenyl groups.

The charge imparting compounds yield particularly high negative charging when dissolved or dispersed in a thermoplastic binder which is a homopolymer or copolymer of styrene wherein the styrene content is preferably at least 50 mole %. Preferred copolymers of styrene for use in toner material according to present invention are: copolymers of styrene-(meth)acrylic acid esters such as styrene-methyl acrylate copolymer, styrene-ethyl acrylate copolymer, styrene-n-butyl acrylate copolymer, styrene-n-octyl acrylate copolymer, styrene-methyl methacrylate copolymer, styrene-ethyl methacrylate copolymer, styrene-n-butyl methacrylate copolymer, styrene-isobutyl methacrylate copolymer, styrene-n-octyl methacrylate copolymer, styrene-heptadecyl methacrylate copolymer. Further are mentioned copoly(styrene-butadiene) and a copolymer of styrene including up to 25% by weight of monomer units comprising a dialkylamino group. Said copolymers can be prepared by common addition polymerisation starting with the monomers involved. Apart from the vinylic copolymers as cited above interesting resin binders for xerographic toners are condensation polymers e.g. polyesters or expoxyresins. Preferred types of such condensation polymers are set forth in U.S. Pat. No. 4,525,445 and include e.g. polyester condensates such as poly(ethylene glycol-terephthalate-isophtalate), poly(ethylene glycol-neopentylene glycol terephthalate-iso phtalate) and modified alkyd resins e.g. resin modified maleic alkyd resins.

Generally, resins particularly suited for use in xerographic toner manufacturing have a melting point (ring and ball method) in the range of 100° to 135° C. more preferably 109° C. to 125° C. and have a glass transition temperature (Tg) larger than 60° C.

The thermoplastic binders referred to above may be used separately or in combination with each other.

In the particulate toner material according to the present invention the colorant may be a dye or pigment soluble or dispersable in the polymeric binder.

In order to obtain toner particles with sufficient optical density in the spectral absorption region of the colorant, the colorant is used preferably in an amount of at least 2% by weight with respect to the total toner composition, more preferably in an amount of 5 to 15% by weight.

For black toners preference is given to carbon black as a colorant.

Examples of carbon black and analogous forms therefore are lamp black, channel black, and furnace black e.g. SPEZIALSCHWARZ IV (trade-name of Degussa Frankfurt/M, W. Germany) and VULCAN XC 72 and CABOT REGAL 400 (trade-names of Cabot Corp. High Street 125, Boston, U.S.A.).

The characteristics of preferred carbon blacks are listed in the following Table 2.

TABLE 2

| | SPEZIALSCHWARZ | CABOT REGAL 400 |
|---|---|---|
| origin | channel black | furnace black |
| density | 1.8 g × $cm^{-3}$ | 1.8 g × $cm^{-3}$ |
| grain size before entering the toner | 25 nm | 25 nm |
| oil number (g of linseed oil adsorbed by 100 g of pigment) | 300 | 70 |
| specific surface (sq. m per g) | 120 | 96 |
| volatile material (% by weight) | 12 | 2.5 |
| pH | 3 | 4.5 |
| colour | brown-black | black |

Toners for the production of colour images may contain organic dyes or pigments of the group of phthalocyanine dyes, quinacridone dyes, triaryl methane dyes, sulphur dyes, acridine dyes, azo dyes and fluoresceine dyes. A review of these dyes can be found in "Organic Chemistry" by Paul Karrer, Elsevier Publishing Company, Inc. New York (1950).

Typical inorganic pigments include black iron(III) oxide, copper(II) oxide and chromium(III) oxide powder, milori blue, ultramarine cobalt blue and barium permanganate.

In order to obtain toner particles having magnetic properties a magnetic or magnetizable material may be added during the toner production.

Magnetic materials suitable for said use are magnetic or magnetizable metals including iron, cobalt, nickel and various magnetizable oxides including (hematite)

$Fe_2O_3$, (magnetite) $Fe_3O_4$, $CrO_2$ and magnetic ferrites, e.g. these derived from zinc, cadmium, barium and manganese. Likewise may be used various magnetic alloys, e.g. permalloys and alloys of cobalt-phosphors, cobalt-nickel and the like or mixtures of any of these. Good results can be obtained with about 30% to about 80% by weight of magnetic material with respect to the resin binder of the toner.

In the preparation of the toner the colorant and optionally magnetic material may be added in finely divided state to the mixture of molten resin binder while stirring until a mixture of homogeneously dispersed or dissolved material in the resin melt is obtained. The mixing temperature is e.g. in the range of 100° to 150° C.

After cooling, the solid mass obtained is crushed and ground e.g. in a hammer mill followed by a jet-mill to an average particle size of 1 to 50 microns. The fraction having a particle size between 1–30 microns separated e.g. by air classification is used. The resulting powder may not be tacky below 50° C.

For a given charge density of the charge-carrying surface the maximum development density attainable with toner particles of a given size is determined by the charge/toner particle mass ratio, which is determined substantially by the triboelectric charge obtained by friction-contact with the carrier particles.

According to one embodiment the toner according to the present invention is applied as single-component developer whereby its negative charge is obtained by frictional contact with elements of the developing unit.

According to another embodiment the toner according to the present invention is applied in a carrier-toner mixture developer wherein the toner acquires a negative charge by frictional contact with the carrier. The carrier-toner mixture is preferably applied to the surface carrying a latent electrostatic image by cascade-, or magnetic brush development which techniques are described in detail by Thomas L. Thourson in his article "Xerographic Development Processes: A Review", IEEE Transactions on Electron Devices, Vol. ED-19, No. 4, April 1972 p. 497–504.

Suitable carrier particles for use in cascade and for magnetic brush development are described in GB-P 1,438,110.

The carrier particles are preferably at least 3 times larger in size than the toner particles and preferably have an average grain size in the range of 50 to 1000 microns, more preferably have an average grain size in the range of 300 to 600 microns when used for cascade development.

The carrier particles may be made of iron or steel optionally provided with an oxide skin. Other suitable types of carriers are on the basis of magnetic material such as ferrites or magnetite finely dispersed in a resin binder material, so-called composite type carriers, examples of which are given in U.S. Pat. No. 4,600,675 and published European patent application 0 289 663. Iron or steel carrier beads may be subjected to special pretreatments to enhance the triboelectric charging of the toner. Suitable coating-treatments of carrier beads are described e.g. in said last mentioned GB-P 1,438,110.

In magnetic brush development the carrier particles are magnetically attractable. Particularly suited are the iron bead carrier particles according to U.S. Pat. No. 2,786,440, which particles have been washed free from grease and other impurities and have a diameter of 0.1 to 0.2 mm.

In a preferred embodiment of the present invention the toner particles are mixed with iron carrier beads of a diameter in the range of 50 to 200 microns having a thin iron oxide skin. These carrier beads have almost a spherical shape and are prepared e.g. by a process as described in GB-P 1,174,571.

The developer composition may for example contain 1 to 5 parts by weight of toner particles per 100 parts by weight of carrier particles.

In order to improve the flowing properties of the developer the toner particles can be mixed with a flow improving substance such as colloidal silica particles and/or microbeads of a fluorinated polymer. The flow improving substance is used e.g. in an amount of 0.05 to 5% more preferably 0.1 to 1% by weight with respect to the toner.

Colloidal silica has been described for use as flow improving substance in the GB-P 1,438,110. Particularly useful is AEROSIL R972 [trade mark of Degussa, Frankfurt (M)—W.Germany] for colloidal silica with hydrofobic character having a specific surface area of 130 sq.m/g. The specific surface area can be measured by a method described by Nelsen and Eggertsen in "Determination of Surface Area Adsorption Measurements by Continuous Flow Method", Analytical Chemistry, Vol. 30, No. 8 (1958) 1387–1390.

Suitable fluorinated polymer beads for improving the flowing properties of the toner as well as of the carrier particles are described in the U.S. Pat. No. 4,187,329. A preferred fluorinated polymer for said use is poly(tetrafluoroethylene) having a particle size of 3 to 4 μm and melting point of 325°–329° C. Such poly(tetrafluoroethylene) is sold under the trade name HOSTAFLON TF-VP-9202 by Farbwerke Hoechst A. G. W. Germany.

Another fluorinated polymer useful for that purpose is polyvinylidene fluoride having an average particle size of 5 μm sold under the trade name KYNAR RESIN 301 by Pennwalt Corp.—Plastic div. England.

The weight proportion of the colloidal silica and said fluorinated polymers with respect to the toner preferably is between 1:10 and 10:1. The toner becomes thereby non-tacky and obtains a reduced tendency to form a film on the xerographic plates or drums. Such drum can e.g. have a vapour-deposited coating of a photoconductive Se-As alloy on a conductive substrate e.g. aluminum.

The following examples illustrate the present invention without, however, limiting it thereto. All parts, ratios and percentages are by weight unless otherwise stated.

FIRST SERIES OF EXAMPLES

Toner Preparation Without Colouring Agent

Pseudo toner was prepared without colouring agent to check whether or not the incorporated charge controlling agent yielded a clear mixture on melting with the elected resin binder.

Comparable colourless pseudo toners were prepared by mixing in the melt 5 parts of a furtheron identified charge controlling substance with 95 parts of copolymer of (styrene-n-butylmethacrylate) (65/35) having a ring and ball softening point of 123° C. and serving as thermoplastic binder. The mixture was melt-kneaded at 130° C. for 30 minutes. Thereupon the mixture was cooled down to room temperature, crushed and then pulverised by milling in a jet mill.

By air classification a toner particle fraction having an average particle size of 13 μm was separated.

Developer Preparation

An electroscopic developer was prepared by mixing 3% of the separated toner particles with iron bead carrier particles having an iron oxide skin and average grain size of 80 μm. The triboelectric charging of the resulting powder mixture was realized by filling a metal cylinder having a diameter of 6 cm for approximately 30% by volume with said mixture and revolving the cylinder at a speed of 60 rpm for 30 minutes.

Measurement

Different triboelectric charge measurement techniques are available all being based on the separation of the toner particles from the admixed carrier particles and the determination of the charge of the separated toner particles directly or indirectly. Depending on the applied technique somewhat differing charge to mass ratio (Q/m) values expressed in coulomb/gram (C/g) are obtained. For obtaining comparable results the same separation and measuring technique should be used with toner of the same average particle size since the triboelectric charging is a surface phenomenon.

In the present example the separation of the toner from the carrier particles was realized in a commercially available blow-off type powder charge measuring device. By calculating the surface area of the pseudo toner for a given mass and using the Q data from the resulting blow-off separation the charge density was calculated, and expressed in $C/cm^2$.

In Table 3 the results obtained with charge controlling compounds Nos. 1 to 14 mentioned hereinbefore are given.

TABLE 3

| Charge controlling agent | $10^{-10}$ $C/cm^2$ |
|---|---|
| No. 1 | −22.0 |
| No. 2 | −31.4 |
| No. 3 | −33.1 |
| No. 4 | −33.5 |
| No. 5 | −38.1 |
| No. 6 | −37.4 |
| No. 7 | −41.5 |
| No. 8 | −40.0 |
| No. 9 | −39.7 |
| No. 10 | −42.6 |
| No. 11 | −40.2 |
| No. 12 | −37.3 |
| No. 13 | −40.6 |
| No. 14 | −32.8 |

The charge density of the developer prepared according to the procedure set forth above, when no charge controlling agent was added, amounted to $-15.2\ 10^{-10}\ C/cm^2$ (=reference value).

The above pseudo toner materials are almost colourless and are perfectly suited for introducing therein any colorant without interference in colour by the charge controlling agents.

SECOND SERIES OF EXAMPLES

Toners and developers were prepared, respectively evaluated, according to the procedure set forth above, with the following differences however. Instead of the (styrene-n-butylmethacrylate) copolymer resin, propoxylated bisphenol A fumarate polyester was used as base resin for a toner. Full particulars of the preparation of this toner are described in the EP-A-nr.89201695.7. When no charge controlling agent was added the charge density of the resulting developer amounted to $-33.2\ 10^{-10}\ C/cm^2$. The results obtained with the charge controlling compound nr. 8, added in an amount of 1, respectively 2% with respect to the toner weight, were in both instances: $-47,\ 10^{-10}\ C/cm^2$.

We claim:

1. Particulate toner material for use in the development of latent electrostatic images, wherein said particulate toner material is capable of acquiring by triboelectric contact electrification a net negative charge and contains thermoplastic resin(s) as binder in combination with a compound capable of imparting a negative charge to the particulate toner material in contact electrification, characterized in that the latter compound corresponds to the following general formula (A):

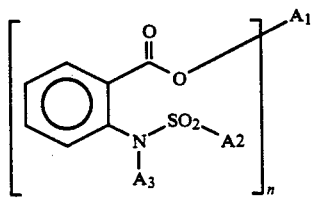

wherein:

$A_1$ is hydrogen, a counter ion or a mono- or polyvalent cyclic or acyclic aliphatic, aromatic or mixed aliphatic-aromatic hydrocarbongroup;

n is 1 when $A_1$ is hydrogen or a monovalent hydrocarbon group or is an integer corresponding to the valency of the counter ion when $A_1$ is a counter ion or corresponding to the valency of the polyvalent hydrocarbon group when $A_1$ is such polyvalent hydrocarbon group;

$A_2$ is an aryl, alkyl or aralkyl group, or substituted aryl, alkyl or aralkyl group, and $A_3$ is hydrogen or an aryl, alkyl, or aralkyl group.

2. Particulate toner material according to claim 1, wherein said compound is used in an amount in the range of 0.25 to 5% by weight with respect to the total toner composition.

3. Particulate toner material according to claim 1, wherein said compound is dissolved or dispersed in a thermoplastic binder being a homopolymer or copolymer of styrene wherein the styrene content is at least 50 mole %.

4. Particulate toner material according to claim 3, wherein said copolymer is selected from the group consisting of styrene-ethyl acrylate copolymer, styrene-n-butyl acrylate copolymer, styrene-n-octyl acrylate copolymer, styrene-methyl methacrylate copolymer, styrene-ethyl methacrylate copolymer, styrene-n-butyl methacrylate copolymer, styrene-isobutyl methacrylate copolymer, styrene-n-octyl methacrylate copolymer, styrene-heptadecyl methacrylate copolymer, copoly(styrene-butadiene), and a copolymer of styrene including up to 25% by weight of monomer units comprising a dialkylamino group.

5. Particulate toner material according to claim 1 wherein said compound is dissolved or dispersed in a thermoplastic binder being a condensation polymer.

6. Particulate toner material according to claim 5 wherein said condensation polymer is a polyester condensate or a modified alkyl resin.

7. Particulate toner material according to claim 1, wherein a colorant is dissolved or dispersed in the thermoplastic resin.

8. Particulate toner material according to claim 7, wherein the colorant is an organic pigment or dye selected from the group consisting of phthalocyanine dyes, quinacridone dyes, triaryl methane dyes, sulphur dyes, acridine dyes, azo dyes and fluoresceine dyes.

9. Particulate toner material according to claim 1, wherein the toner particles incorporate a magnetic or magnetizable material.

10. A toner-carrier mixture for use in cascade-, or magnetic brush development of latent electrostatic charge images wherein the toner material is a toner material according to claim 1.

11. A toner-carrier mixture according to claim 10, wherein the carrier particles are at least 3 times larger in size than the toner particles and have an average grain size in the range of 50 to 1000 microns.

12. A toner-carrier mixture according to claim 10, wherein the carrier particles are made of iron or steel provided with an oxide skin.

* * * * *